US006418685B1

(12) United States Patent
Oliver et al.

(10) Patent No.: US 6,418,685 B1
(45) Date of Patent: Jul. 16, 2002

(54) ANCHOR STRAP FRAME CLAMP

(76) Inventors: James Oliver; Evon L. Oliver, both of P.O. Box 8, Hohenwald, TN (US) 38462

( * ) Notice: Subject to any disclaimer, the term of this patent is extended or adjusted under 35 U.S.C. 154(b) by 0 days.

(21) Appl. No.: 09/711,727

(22) Filed: Nov. 14, 2000

(51) Int. Cl.[7] ..... E02D 27/50

(52) U.S. Cl. ..... 52/293.3; 52/148; 52/23; 52/169.9; 52/DIG. 11; 248/503; 248/508; 24/199; 24/311

(58) Field of Search ..... 52/23, 167.3, 169.9, 52/157, 156, 148, 146, 293.3, 149, 126.6, DIG. 11; 248/503, 508, 680; 403/353; 24/191, 199, 269, 311

(56) References Cited

U.S. PATENT DOCUMENTS

| | | | | | |
|---|---|---|---|---|---|
| 817,686 | A | * | 4/1906 | Ames | 24/199 |
| 3,485,112 | A | * | 12/1969 | Goosmann | 24/192 |
| 3,747,288 | A | * | 7/1973 | Grimelii | 52/23 |
| 3,750,866 | A | * | 8/1973 | Renchen | 52/23 |
| 3,845,597 | A | * | 11/1974 | Foster | 52/166 |
| 5,402,614 | A | * | 4/1995 | Jewell | 52/169.9 |
| 5,697,191 | A | * | 12/1997 | MarKarvich | 52/169.9 |
| 5,701,715 | A | * | 12/1997 | Masters et al. | 52/23 X |
| 5,983,573 | A | * | 11/1999 | Mackarvich | 52/23 |
| 6,176,056 | B1 | * | 1/2001 | MacKarvich | 52/293.3 |
| 6,243,998 | B1 | * | 6/2001 | MacKarvich | 52/167.3 |
| 6,256,940 | B1 | * | 7/2001 | MacKarvich | 52/169.9 |

* cited by examiner

*Primary Examiner*—Carl D. Friedman
*Assistant Examiner*—Winnie Yip
(74) *Attorney, Agent, or Firm*—Calif Tervo

(57) ABSTRACT

A frame clamp for an anchor strap assembly (10) for a manufactured home (70) having a frame member (74), such as an I-beam (75), and supported above ground (99), such as by piers (91). Anchor strap assembly (10) includes elongate anchor strap (30) connecting a ground anchor (20) to frame clamp (40). Ground anchor (20) includes head (22) fixed near ground (99) to the side of beam (75). Clamp (40) attaches top end (34) of strap (30) to beam (75) and comprises stationary jaw (42) and movable jaw (60) joined such that movable jaw (60) to which strap (30) is attached is pivotable about axis (58) perpendicular to the plane of strap (30) and such that movable jaw (60) is hinged such that tensioning strap (30) clamps beam (75) between jaws (42, 61). Clamp (40) is easily attached and prevents strap breakage during home movement such as during an earthquake or storm.

7 Claims, 2 Drawing Sheets

ANCHOR STRAP FRAME CLAMP

FIELD OF THE INVENTION

This invention relates in general to ground anchors for manufactured homes, and more specifically involves a clamp connecting an anchor strap to the I-beam frame of a manufactured home.

BACKGROUND OF THE INVENTION

A typical manufactured home has a frame comprising a pair of longitudinal support beams that are supported at a height above the ground to allow for ventilation and crawl space. Common supports include piers and blocks. Manufactured homes may also be anchored to the ground to help prevent lateral movement due to earthquakes or high winds.

Conventional anchor systems include an anchor head located near the ground at a position off to the side of a beam. The anchor head is typically held in position by being connected to a ground anchor, typically an auger and shaft, driven into the ground. The head may rotate to align with the strap direction. A solid steel strap connects the anchor head and the beam. The strap is tensioned, such as by wrapping the strap around a tensioning bolt in the head. Typically, a clamp is attached to the beam and the strap is attached to the clamp.

A problem with conventional anchor systems is the tendency for the steel anchor straps to break during considerable longitudinal movement of the manufactured home such as may be encountered in earthquakes and hurricanes. The failure of the anchor strap can then result in catastrophic failure of the support system as the home can teeter off its piers.

Longitudinal movement of the home puts great stress on one side of the strap. This causes the strap to rip at a weak point in the strap or at a point of a stress riser, such as its attachment point to the beam or to the beam clamp.

Therefore, there has been a need for a device that reduces the likelihood of anchor strap breakage from movement of anchored item such as a manufactured home.

SUMMARY OF THE INVENTION

The invention is a frame clamp for an anchor strap assembly for a manufactured home having a support beam, such as an I-beam, and supported above the ground, such as by piers. The anchor strap assembly includes an elongate anchor strap connecting a ground anchor to the frame clamp. The ground anchor includes a head fixed near the ground to the side of the beam.

The clamp attaches the top end of the strap to the beam and comprises a stationary jaw and a movable jaw. The stationary jaw overlies the top side of the beam and projects downward to engage the distal side of the beam. The movable jaw includes a connecting portion including means for attaching the strap and a contact area. The jaws are joined such that the movable jaw connecting portion is pivotable relative to the stationary jaw about an axis perpendicular to the plane of the strap and such that the movable jaw is hinged relative to stationary jaw such that tensioning the strap moves the contact area toward the stationary jaw so as to clamp the beam therebetween.

In this manner, a very simple clamp, which is extremely easy to apply, has a pivoting feature that reduces strap breakage.

Other features and advantages of the invention will be readily understood when the detailed description thereof is read in conjunction with the accompanying drawings wherein like reference numerals refer to like parts throughout.

DETAILED DESCRIPTION OF THE INVENTION

Figure 1:
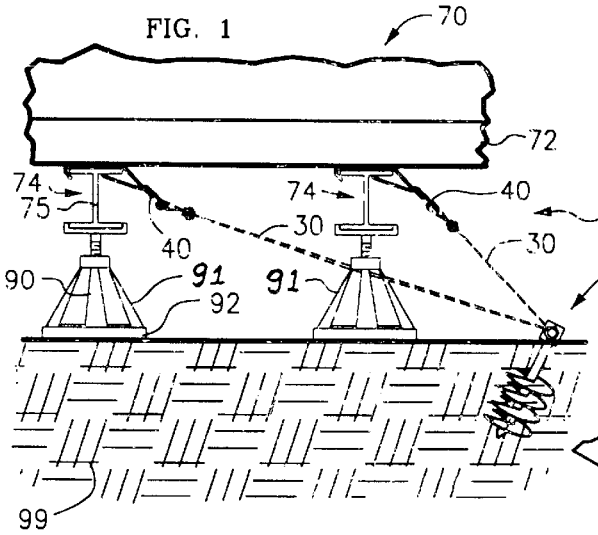
FIG. 1 is a left side elevation view of the frame clamp of the invention shown in use in stabilizing a manufactured home.
Figure 2:
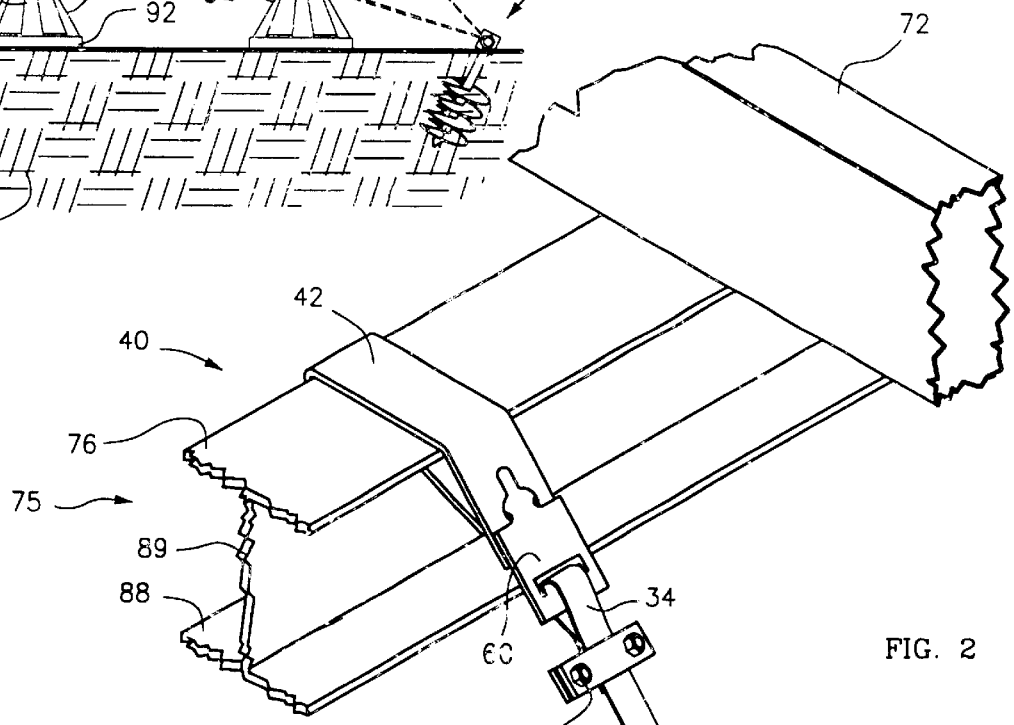
FIG. 2 is an enlarged perspective view of the frame clamp of FIG. 1 attaching an anchor strap to the I-beam frame of the manufactured home.

With reference now to the drawings, FIG. 1 is a left side elevation view of a preferred embodiment of the anchor strap assembly 10 including frame clamp 40 of the invention shown in use in stabilizing a manufactured home 70, and FIG. 2 is an enlarged perspective view of anchor strap assembly 10 of FIG. 1. Manufactured home 70 generally includes a plurality of spaced transverse floor joists 72 that are supported by a plurality, typically two, longitudinal frame members such as beams 74, such as I-beams 75. As best seen in FIG. 2, I-beam 75 includes a longitudinal flange, such as top flange 76, and a bottom flange 88 joined by a web 89. A plurality of supports 90, such as jacks or piers 91, are disposed along the length of I-Beams 75 for supporting home 70 a distance above the ground 99 such that there is a crawl space and ventilation under home 70. A foundation or foundation pads 92 supports piers 91.

Anchor strap assembly 10 resists lateral forces on home 70. Anchor strap assembly generally includes a ground anchor 20, an elongate anchor strap 30, and frame clamp 40. As best seen in FIG. 1, anchor strap assembly 10 may include one or more additional anchor straps 30 and clamps 40 attached to other beams 74. Ground anchor 20 may be of conventional design and includes an anchor head 22 disposed near the ground to the side of beam 75. Anchor head 22 is attached to a retaining object, such as a foundation or anchor shank 29, partially shown, so as to be fixed in position. Head 22 includes strap tensioning means, such as one or more tensioning bolts 25, for tensioning anchor strap 30. Anchor strap 30 is of conventional design being an elongate, wide, solid flat metal strap, such as of high tension steel. Strap 30 has a bottom end 32, a top end 34 and a mid-section 39 therebetween. Top end 34 may be formed into a loop held by attachment means, such as a clamp 36, for attachment to clamp 40. Strap 30 has a length and width defining a strap plane. Clamp 40 includes a stationary jaw 42 and a movable jaw 60.

Figure 3:
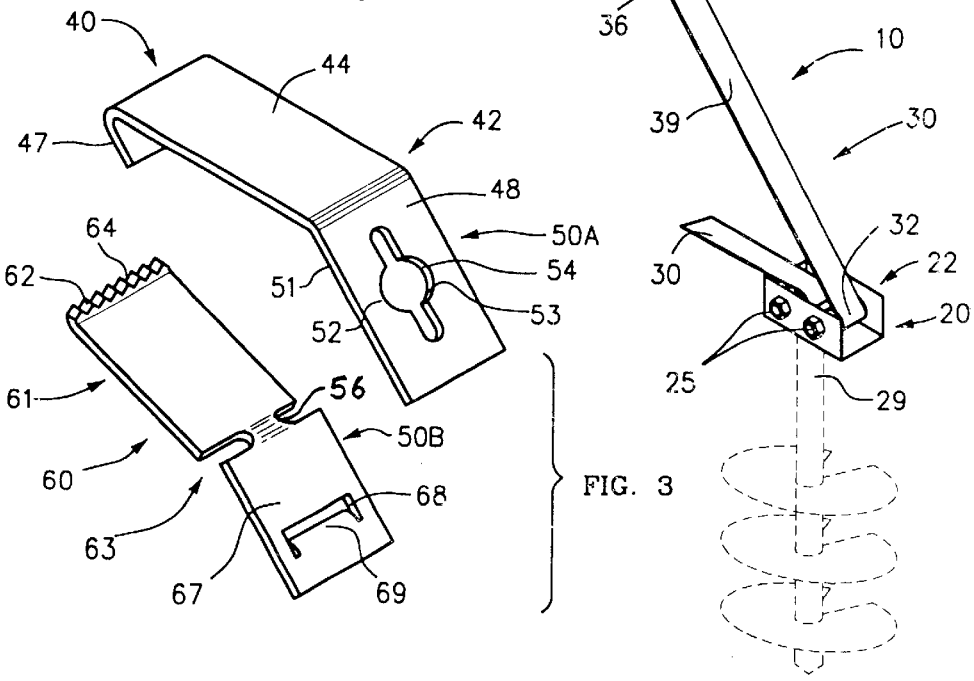
FIG. 3 is an enlarged exploded view of the frame clamp of FIG. 2.
Figure 5:
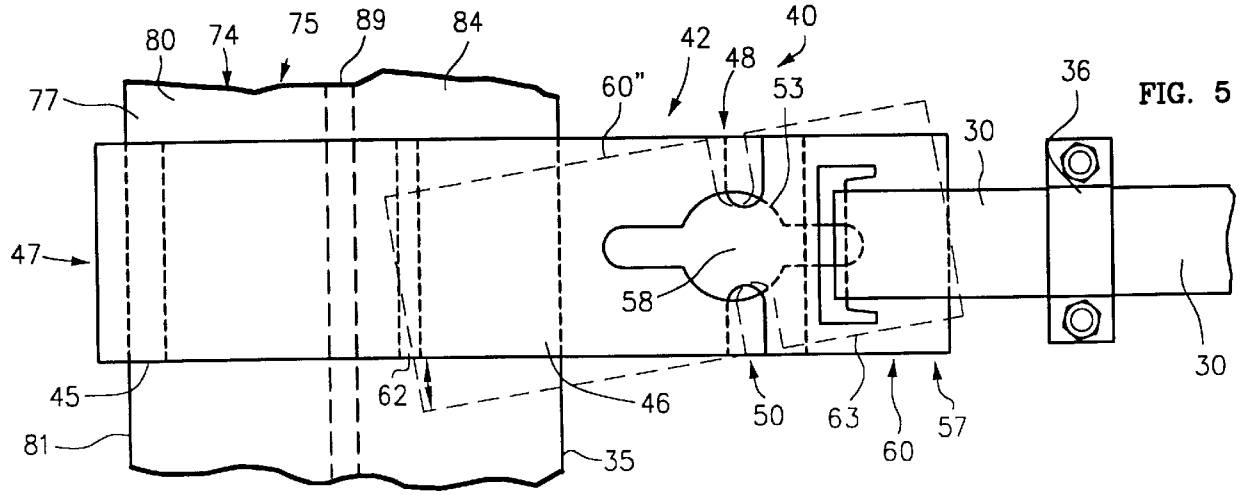
FIG. 5 is a top plan view of the clamp, frame and strap of FIG. 3.
Figure 4:
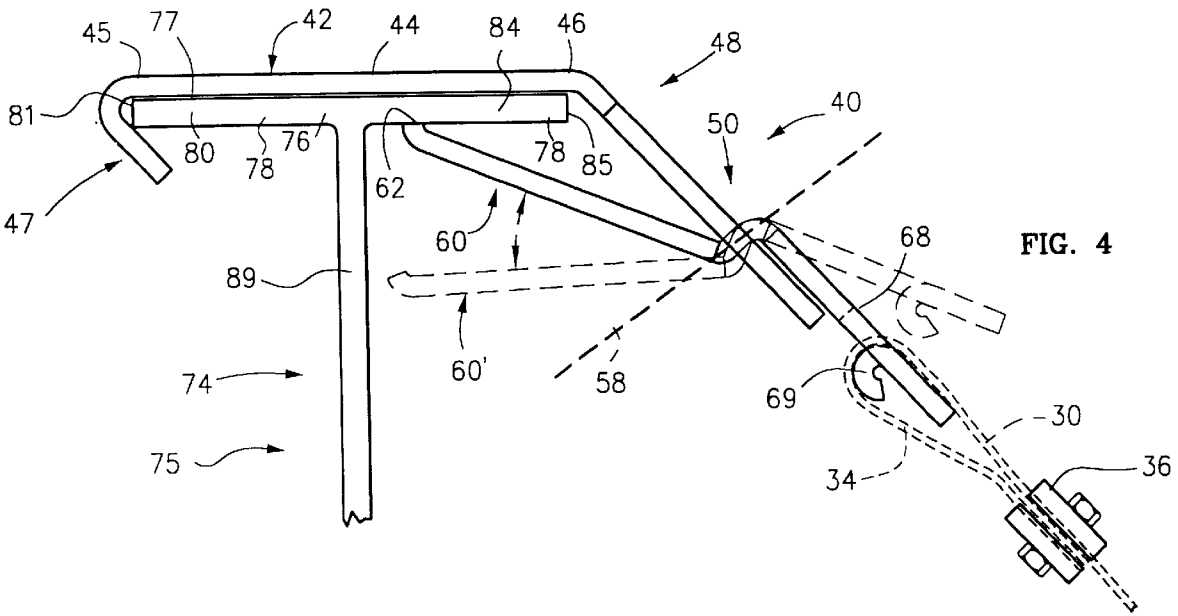
FIG. 4 is an enlarged left side elevation view of the clamp, frame and strap of FIG. 2, attached to the I-beam.

Looking additionally at FIGS. 3–5, FIG. 3 is an enlarged exploded view of clamp 40 of FIG. 2; FIG. 4 is an enlarged left side elevation view of clamp 40, frame member 75 and strap 30 of FIG. 3; and FIG. 5 is a top plan view of the elements of FIG. 3. I-beam 75 top flange 76 includes a top side 77, a bottom side 78, a distal portion 80 disposed away from strap 30 and a proximal portion 84 disposed toward strap 30. Distal portion 80 includes an edge 81. Proximal portion 84 includes an edge 85 between top side 77 and bottom side 78.

Clamp 40 includes a stationary jaw 42 and a movable jaw 60. Preferably, stationary jaw 42 is attached to beam 75 so as to not move relative to beam 75. Stationary jaw 42 generally includes a central portion 44, an engaging portion 47 and a proximal portion 48. Central portion 44, adapted for overlying top side 77 of beam 75, has a distal end 45 and a proximal end 46.

Engaging portion 47 is connected to central portion distal end 45 and projects downward from central portion 44 for engaging I-beam distal edge 81. The shape of engaging portion 47 may vary according to the shape of the frame member to which it is adapted. In the illustrative example, engaging portion 47 is hook-shaped or J-shaped so as to pass around and even slightly under edge 81 of beam flange distal portion 80 so as to resist disengagement when tension is applied to clamp 40 via strap 30. Engaging portion 47 may have gripping means, such as teeth, to engage edge 81 of a beam 74 of different shape, such as of a C-beam.

Proximal portion 48 is connected to central portion 44, such as to proximal end 46, and preferably slants downward so as to be substantially in the plane of attached strap 30.

Movable jaw 60 generally comprises two end portions, a gripping portion 61 and a connecting portion 67, and a central portion 63 joining the two end portions. Gripping portion 61 includes a contact area 62, such as toothed area 64, for contacting bottom side 78 offrame 74 opposite clamp central portion 44.

Connecting portion 63 includes attaching means, such as thru slot 68, for attaching anchor strap 30. Preferably, the attaching means is adapted so as to not induce high stress points on strap 30 so as to cause tears. To this end, slot 68 includes a radiused surface 69 around which strap 30 is run for applying tension to strap 30.

Central portion 63 connects gripping portion 61 to connecting portion 67.

Stationary jaw 42 and movable jaw 60 include cooperative joining means 50 for joining jaws 42, 60 such that movable jaw connecting portion 67 is pivotable relative to stationary jaw 42 about an axis, such as pivot axis, 58, perpendicular to the plane of attached strap 30. Movable jaw 60 is hinged relative to stationary jaw 42 such that tensioning attached anchor strap 30 moves contact area 62 toward central portion 44 of stationary jaw 42 so as to clamp frame 74, such as proximal flange 84, therebetween.

In the illustrative example of FIG. 3, stationary jaw joining means 50A includes joining slot 51 and connected bore 52. Bore 52 includes a bearing 53 including a radiused bearing surface 54. Movable jaw joining means 50B includes a journal 56 adapted for bearing on bearing surface 54.

Jaws 42, 60 are joined as follows. One end, that is gripping portion 61 or connecting portion 67, of movable jaw 60, is passed through stationary jaw joining means 50A such that journal 56 is in bearing 54. Gripping portion 61 is adapted, such as being wider than journal 56, so as to engage stationary jaw 42, i.e. so as to not be pulled through bore 54, when journal 56 is in bearing 54 and strap 30 is tensioned. The hinging movement of movable jaw 60 is best illustrated in FIG. 4 where an alternate position 60' of movable jaw 60 is shown in phantom. The pivoting movement of movable jaw 60 is best seen in FIG. 5 where an alternate position 60" of movable jaw 60 is shown in phantom. The hinge bearing surfaces and the pivot bearing surfaces are substantially the same surfaces.

It can be appreciated that if beam 75 moves slightly longitudinally, such as during an earthquake, connecting portion 67 pivots such that less severe stresses and tearing forces are induced to strap 30 and less severe twisting on stationary jaw 42. The elements of the embodiment shown allow pivoting up to about 45 degrees in either direction or to about ninety degrees total. Preferably, the allowable pivot angle in either direction should be greater than 20 degrees to maintain anchor integrity after movement.

Clamp 40 is made of strong material that can withstand the forces exerted thereon, such as steel.

Having described the invention, it can be seen that it provides an excellent device for anchoring a beam with an anchor strap in a manner that is more likely to provide anchoring during movement of the beam.

Although a particular embodiment of the invention has been illustrated and described, various changes may be made in the form, composition, construction, and arrangement of the parts herein without sacrificing any of its advantages. Therefore, it is to be understood that all matter herein is to be interpreted as illustrative and not in any limiting sense, and it is intended to cover in the appended claims such modifications as come within the true spirit and scope of the invention.

In the claims, directional terms, such top and bottom, are relative and are not to be construed in an absolute sense.

We claim:

1. A clamp for attaching an elongate anchor strap to a frame component; the strap having a length and width defining a strap plane; the frame component having a top side, a bottom side, a distal edge, and a proximal edge; said clamp comprising:

a stationary jaw comprising:

a central portion adapted for overlying the top side of the frame component; said central portion including:

a distal end; and a proximal end;

a engaging portion connected to said central portion distal end and projecting downward from said central portion for engaging the frame component distal edge; and a proximal portion connected to said central portion; and a movable jaw comprising:

a gripping portion including:

a contact area for contacting said bottom side of the frame component opposite said central portion;

a connecting portion including:

means for attaching the anchor strap; and a central portion connecting said gripping portion to said connecting portion; wherein said central portion and said proximal portion include cooperative joining means joining said movable jaw to said stationary jaw such that said movable jaw proximal end is pivotable relative to said stationary jaw about an axis perpendicular to the plane of an attached strap; and such that said movable jaw is hinged about an axis parallel to the plane of an attached strap relative to stationary jaw such that tensioning an attached anchor strap urges said contact area of said gripping portion of said movable jaw toward said central portion of stationary member so as to clamp the frame component therebetween.

2. The clamp of claim 1 wherein:

said central portion of said movable jaw includes:

a journal; and said proximal portion of said stationary jaw includes:

a mating bearing.

3. A clamp for attaching an elongate anchor strap to a frame component; the strap having a length and width defining a strap plane; the frame component having a top side, a bottom side, a distal edge, and a proximal edge; said clamp comprising:

a stationary jaw comprising:
a central portion adapted for overlying the top side of the frame component; said central portion including:
a distal end; and
a proximal end;
a engaging portion connected to said central portion distal end and projecting downward from said central portion for engaging the frame component distal edge; and
a proximal portion connected to said central portion; and a movable jaw comprising:
a gripping portion including:
a contact area for contacting said bottom side of the frame component opposite said central portion;
a connecting portion including:
means for attaching the anchor strap; and
a central portion connecting said gripping portion to said connecting portion; wherein said central portion and said proximal portion include cooperative joining means joining said movable jaw to said stationary jaw such that said movable jaw proximal end is pivotable relative to said stationary jaw about an axis perpendicular to the plane of an attached strap; and such that said movable jaw is hinged relative to stationary jaw such that tensioning an attached anchor strap urges said contact area of said gripping portion of said movable jaw toward said central portion of stationary member so as to clamp the frame component therebetween; and wherein: said central portion of said movable jaw includes: a journal; and said proximal portion of said stationary jaw includes: a mating bearing.

4. In combination with a manufactured home supported above the ground; the home including a support beam including: a flange including: a top side; a bottom side; a distal edge; and a proximal edge; and an anchor head disposed near the ground to the side of the beam; an anchor strap assembly including:

an elongate anchor strap including:
a bottom end connected to the anchor head; and
a top end; said strap having a length and width defining a strap plane; and a clamp attaching said top end of said strap to the beam; said clamp comprising:
a stationary jaw comprising:
a central portion adapted for overlying the top side of the flange; said central portion including:
a distal end; and
a proximal end;
an engaging portion connected to said central portion distal end and projecting downward from said central portion for engaging the flange distal edge; and
a proximal portion connected to said central portion; and
a movable jaw comprising:
a gripping portion including:
a contact area for contacting said bottom side of the frame component opposite said central portion;
a connecting portion including:
attaching means for attaching said anchor strap; said top end of said anchor strap being attached to said attachment means; and
a central portion connecting said gripping portion to said connecting portion; wherein said central portion and said proximal portion include cooperative joining means joining said movable jaw to said stationary jaw such that said movable jaw proximal end is pivotable relative to said stationary jaw about an axis perpendicular to the plane of an attached strap; and such that said movable jaw is hinged relative to stationary jaw such that tensioning said attached anchor strap moves urges said contact area of said gripping portion of said movable jaw toward said central portion of stationary member so as to clamp the flange therebetween; wherein: said central portion of said movable jaw includes: a journal; and said proximal portion of said stationary jaw includes: a mating bearing.

5. The combination of claim 4 wherein:

said beam is an I-beam.

6. In combination:

a manufactured home including:
a support beam including:
a flange including:
a first side;
a second side;
a distal edge; and
a proximal edge;
supports supporting said home above the ground;
an anchor strap assembly including:
an elongate anchor strap including:
a bottom end; and
a top end;
an anchor head disposed near the ground to the side of said beam; said anchor head connected to said bottom end of said anchor strap; and
a clamp attaching said top end of said anchor strap to said beam; said clamp comprising:
a stationary jaw comprising:
a central portion adapted for overlying the top side of said flange; said central portion including:
a distal end; and
a proximal end;
an engaging portion connected to said central portion distal end and projecting downward from said central portion for engaging said flange distal edge; and
a proximal portion connected to said central portion; and
a movable jaw comprising:
a gripping portion including:
a contact area for contacting said bottom side of the frame component opposite said central portion;
a connecting portion including:
attaching means for attaching said anchor strap; said top end of said anchor strap being attached to said attachment means; and
a central portion connecting said gripping portion to said connecting portion; wherein said central portion and said proximal portion include cooperative joining means joining said movable jaw to said stationary jaw such that said movable jaw connecting portion is pivotable relative to said stationary jaw about an axis perpendicular to the plane of an attached strap; and such that said movable jaw is hinged relative to stationary jaw such that tensioning said attached anchor strap urges said contact area of said gripping portion of said movable jaw toward said central portion of stationary member so as to clamp said flange therebetween; wherein: said central portion of said movable jaw includes: a journal; and said proximal portion of said stationary jaw includes: a mating bearing.

7. The combination of claim 6 wherein:

said beam is an I-beam.

* * * * *